US006262522B1

(12) United States Patent
Osamura et al.

(10) Patent No.: US 6,262,522 B1
(45) **Date of Patent: *Jul. 17, 2001**

(54) SPARK PLUG FOR INTERNAL COMBUSTION ENGINE

(75) Inventors: Hironori Osamura, Chiryu; Nobuo Abe, Yokkaichi; Keiji Kanao, Okazaki; Kenji Horibe, Nishikasugai-gun, all of (JP)

(73) Assignee: Denso Corporation, Kariya (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/933,838

(22) Filed: Sep. 19, 1997

Related U.S. Application Data

(63) Continuation-in-part of application No. 08/663,528, filed on Jun. 13, 1996, now Pat. No. 6,094,000.

(30) Foreign Application Priority Data

Jun. 15, 1995 (JP) ..... 7-148649

(51) Int. Cl.[7] ..... H01T 13/20
(52) U.S. Cl. ..... 313/141; 313/144
(58) Field of Search ..... 313/141, 144; 123/169 EL; 252/514, 520

(56) References Cited

U.S. PATENT DOCUMENTS 1,850,819 3/1932 Waltenberg et al. .
3,958,144 5/1976 Franks ..... 313/141 X (List continued on next page.)

FOREIGN PATENT DOCUMENTS

88107237 * 9/1989 (CN) .
3036223 4/1981 (DE) .

(List continued on next page.)

OTHER PUBLICATIONS

Japanese Official Action dated Sep. 9, 1997.

Applicant's Comments with Reference Figures 1 and 2.

"High Temperature Behaviour of Iridium–Rhodium Alloys, Oxidation Resistance and Compatibility," Platinum Metals Review, Apr. 1967, vol. 11, No. 2, pp. 53–55.

*Primary Examiner*—Ashok Patel
(74) *Attorney, Agent, or Firm*—Pillsbury Winthrop LLP

(57) ABSTRACT

A spark plug including an insulation porcelain having a throughhole; a center electrode held at one end of the throughhole; a housing holding the insulation porcelain; a ground electrode disposed at a front end of the housing and facing the center electrode; a spark gap defined by the center electrode and the ground electrode; and at least one of the center and ground electrodes having a nobel metal member bonded to a discharging spot of its front end, wherein the nobel metal member consists of 90 wt % or more of an Ir—Rh alloy containing 1 to 60 wt % Rh and the balance substantially consisting of at least one of Pt, Pb, Ru, Au and Ni.

4 Claims, 3 Drawing Sheets

U.S. PATENT DOCUMENTS

| | | | |
|---|---|---|---|
| 4,081,710 | 3/1978 | Heywood et al. . | |
| 4,122,366 | 10/1978 | Von Stutterheim et al. | 313/141 |
| 4,324,588 | 4/1982 | Zysk et al. | 313/141 X |
| 4,540,910 | 9/1985 | Kondo et al. | 313/141 X |
| 4,659,960 | 4/1987 | Toya et al. | 313/141 |
| 4,700,103 | 10/1987 | Yamaguchi et al. . | |
| 4,743,793 | 5/1988 | Toya et al. | 313/141 |
| 5,440,198 | 8/1995 | Oshima et al. . | |
| 5,853,904 | 12/1998 | Hall et al. . | |

FOREIGN PATENT DOCUMENTS

| | | |
|---|---|---|
| 4331269 | 3/1995 | (DE) . |
| 0 171 994 | 2/1986 | (EP) . |
| 0 635 920 | 1/1995 | (EP) . |
| 479540 | 2/1938 | (GB) . |
| 148891 | 3/1942 | (JP) . |
| 48-013730 | 2/1973 | (JP) . |
| 50-077738 | 8/1975 | (JP) . |
| 57-130384 | 8/1982 | (JP) . |
| 58-209879 | 12/1983 | (JP) . |
| 60-246580 | 12/1985 | (JP) . |
| 6-45583 | 3/1986 | (JP) . |
| 61-44141 | 3/1986 | (JP) . |
| 63-57919 | 11/1988 | (JP) . |
| 63-57979 | 11/1988 | (JP) . |
| 2-049388 | 2/1990 | (JP) . |
| 2-186579 | 7/1990 | (JP) . |
| 3-110779 | 5/1991 | (JP) . |
| 3-176979 | 7/1991 | (JP) . |
| 5-54953 | 3/1993 | (JP) . |
| 5-101869 | 4/1993 | (JP) . |
| 5-159854 | 6/1993 | (JP) . |
| 6-36856 | 2/1994 | (JP) . |
| 7-011974 | 2/1995 | (JP) . |
| 9-7733 | 1/1997 | (JP) . |

* cited by examiner

SPARK PLUG FOR INTERNAL COMBUSTION ENGINE

This is a Continuation-in-Part of U.S. patent application Ser. No. 08/663,528 filed Jun. 13, 1996, now U.S. Pat. No. 6,094,000 which designated the U.S.

BACKGROUND OF THE INVENTION

1. Field of the Invention

The present invention relates to a spark plug for an internal combustion engine and a noble metal chip for the electrodes of the spark plug.

2. Description of the Related Art

With regard to spark plugs for internal combustion engines, it is a continuing need to improve the lifetime (i.e., to improve the consumption resistance) and the performance (i.e., to improve the spark flyability and the ignitability). To this end, attempts have been made to use a noble metal chip, particularly of Pt, as a discharging element of the spark plug for an internal combustion engine.

Recently, there is an increasing need to further improve the lifetime and the performance. To this end, studies have been conducted to use a noble metal chip made of Ir having a melting point higher than that of Pt.

Although Ir advantageously has a melting point of 2454° C., which is much higher than that of Pt, it also has a disadvantage that the volatilization consumption is undesirably accelerated at elevated temperatures above 900° C.

To suppress the volatilization consumption of Ir, Japanese Unexamined Patent Publication (Kokai) No. 2-186579 proposed introduction of Al, Y or other elements having a strong affinity for oxygen and precipitation thereof to form an oxidation-protection film over the surface of an Ir electrode, thereby preventing the volatilization consumption of Ir.

However, the proposal had a drawback that the oxidation-protection film is composed of alumina, yttria, or other ceramics, which provides poor bond with the Ir noble metal and causes spalling thereof.

Japanese Unexamined Patent Publication (Kokai) No. 2-49388 proposed addition of Pt to Ir, but could not provide a satisfactory noble metal chip having a sufficiently improved consumption resistance and heat resistance at high temperatures.

SUMMARY OF THE INVENTION

An object of the present invention is to provide a spark plug having a noble metal chip bonded to the discharging spot thereof and having an improved heat resistance and consumption resistance at high temperatures.

Another object of the present invention is to provide a noble metal chip for a spark plug, the chip having an improved heat resistance and consumption resistance at high temperatures.

To achieve the object according to the present invention, a spark plug has a noble metal chip bonded to the discharging spot thereof, the chip consisting of an Ir—Rh alloy containing Rh in a specified amount to cause enrichment and precipitation of Rh on the chip surface and the precipitated Rh forms an oxidation-protection film. Because Rh is a noble metal having a high melting point and forming a strong bond with the chip body of the Ir—Rh alloy, the oxidation-protection film of the present invention provides an improved consumption resistance and heat resistance at high temperatures.

The alloying of Ir with Rh advantageously provides a noble metal chip having an improved consumption resistance and heat resistance at high temperatures, so that the noble metal chip of the present invention, when used in the spark plug of an internal combustion engine, allows reduction in the electrode diameter, and thereby improves the performance of the spark plug for an internal combustion engine, particularly a reduced discharging voltage and an improved ignitability.

DESCRIPTION OF THE PREFERRED EMBODIMENTS

Figure 1:
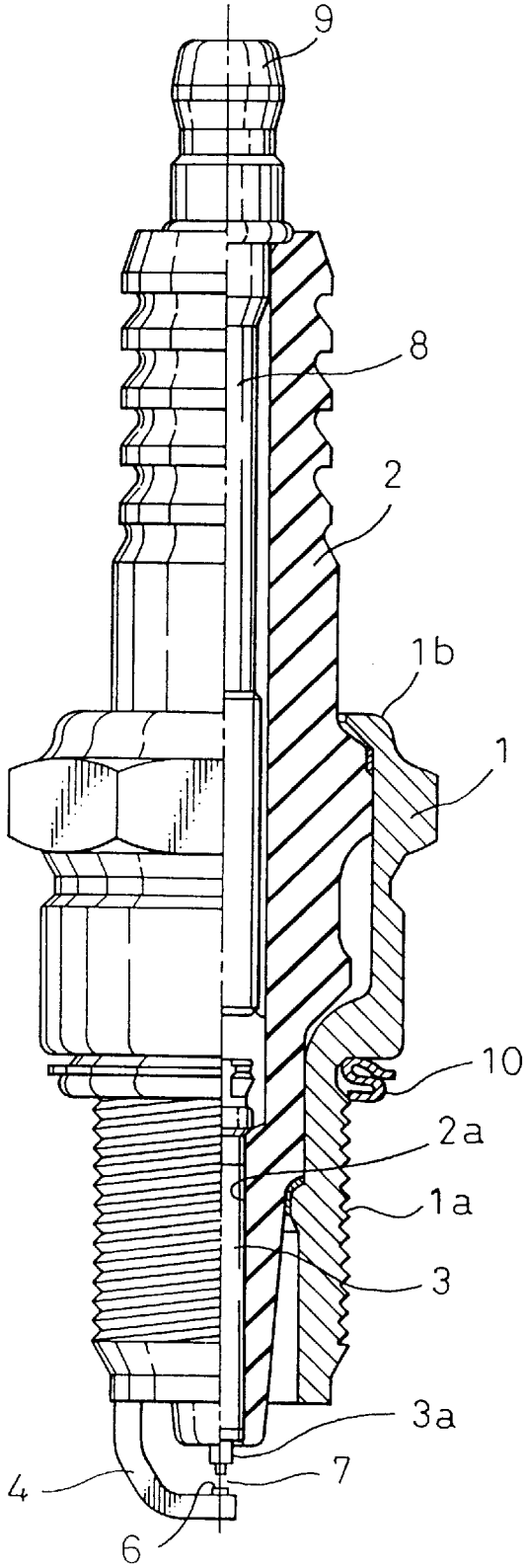
FIG. 1 is a semi-cross-sectional view of a spark plug for an internal combustion engine according to the present invention.

According to the present invention, a spark plug for an internal combustion engine comprises:

an insulation porcelain (2) having a throughhole **(2*a*)**;

a center electrode (3) held at one end of the throughhole **(2*a*)**;

a housing (1) holding the insulation porcelain (2);

a ground electrode (4) disposed at an front end of the housing (1) and facing the center electrode (3);

a spark gap (7) defined by the center electrode (3) and the ground electrode (4); and the center electrode (3) and/or the ground electrode (4) having a noble metal chip (5, 6) bonded to a discharging spot of an front end thereof, wherein the noble metal chip (5, 6) consisting of an Ir—Rh alloy contains Rh in an amount of from 1 wt % to 60 wt %, preferably from 3 wt % to 30 wt %.

The Ir—Rh alloy preferably further contains an oxide of an element of the group 3A or 4A of the periodic table in an amount of from 0.5 wt % to 5 wt %. The oxide of the element of the group 3A preferably consists of $Y_2O_3$. The oxide of the element of the group 4A preferably consists of $ZrO_3$.

In a preferred embodiment of the present invention, the center electrode has the noble metal chip having an outer diameter A and a height B which are within the range defined by the following formulae:

$$0.5\ mm \leqq A \leqq 2.0\ mm, \text{ and}$$

$$0.3\ mm \leqq B \leqq 2.5\ mm.$$

In a more preferred embodiment of the present invention, the ground electrode has the noble metal chip having an outer diameter C and a height D which are within the range defined by the following formulae:

$$0.5\ mm \leqq C \leqq 1.7\ mm, \text{ and}$$

$$0.3\ mm \leqq D \leqq 1.0\ mm.$$

The center electrode and/or the ground electrode preferably have a shell portion composed of a Ni alloy and have the nobel metal chip bonded to the discharging spot of the front end thereof by laser welding or resistance welding.

EXAMPLES

Figure 2:
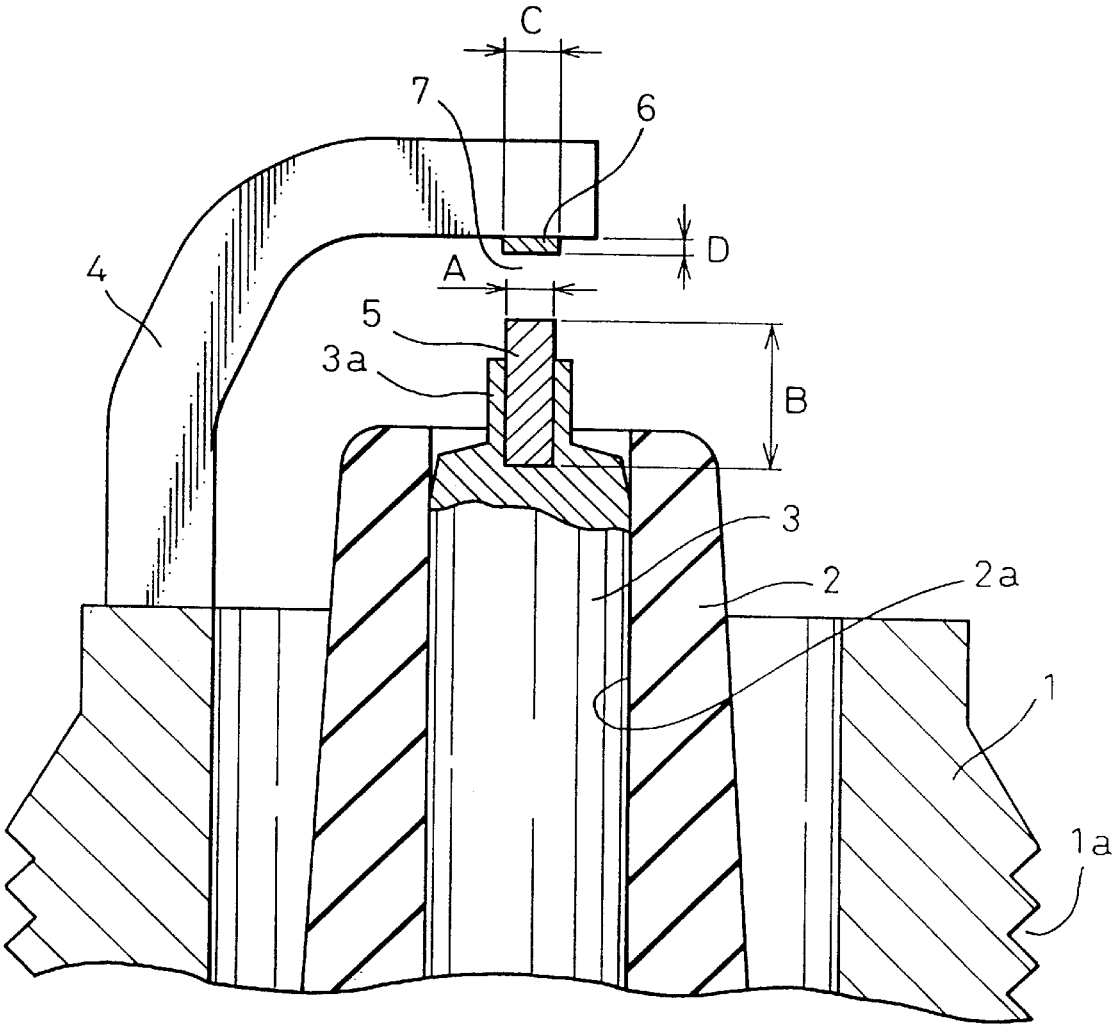
FIG. 2 is an enlarged partial cross-sectional view of the spark plug shown in FIG. 1.

FIG. 1 is a semi-cross-sectional view of a spark plug for an internal combustion engine according to the present invention. FIG. 2 is a partial cross-sectional view showing the lower end portion of the plug shown in FIG. 1. The spark plug has a tubular housing 1 made of iron or other metal and having a thread la on the outer circumferential surface at the lower portion.

A tubular insulation porcelain 2 is made of alumina or other insulating material and has a lower portion coaxially engaged in the housing 1 with the upper end 1*b* caulked to bond the housing 1 and the insulation porcelain 2 to form an integrated unit. A center electrode 3 is fittingly engaged in one end (or a lower end) of a throughhole (or hollow portion) 2*a* of the insulation porcelain 2.

The center electrode 3 is made in the form of a cylinder composed of a cupper core surrounded by a heat resistant Ni shell. The center electrode 3 has a front end 3*a* exposed from the lower end of the insulation porcelain 2.

A ground electrode 4 extends upward from an end surface of the housing 1 and bows right so that the leading end thereof faces the front end 3*a* of the center electrode 3. The ground electrode 4 is also made of a Ni alloy. Noble metal chips 5 and 6 are bonded to the front end 3*a* of the center electrode 3 and the discharging spot of the ground electrode 4 facing the front end 3*a* by laser or resistance welding to form a spark gap 7 therebetween.

A center pin 8 and a terminal 9 are electrically connected to an upper end of the center electrode 3 as is well known in the art. The terminal 9 is to be connected to an external circuit for applying a high voltage to generate a spark. A seal gasket 10 surrounds the casing 1 at the upper end of the thread 1*a* for mounting the plug on an engine.

The most important feature of the present invention resides in the alloy material of the noble metal chips 5 and 6, i.e., at least one of the chips 5 and 6 is composed of an Ir—Rh alloy based on Ir (iridium), which has a high melting point and good consumption resistance, and containing Rh (rhodium) for preventing Ir from volatilizing at high temperatures.

The present inventors have conducted an experiment to determine the noble metal chips 5 and 6 composed of the Ir—Rh alloy. The results are shown in FIG. 3.

Figure 3:
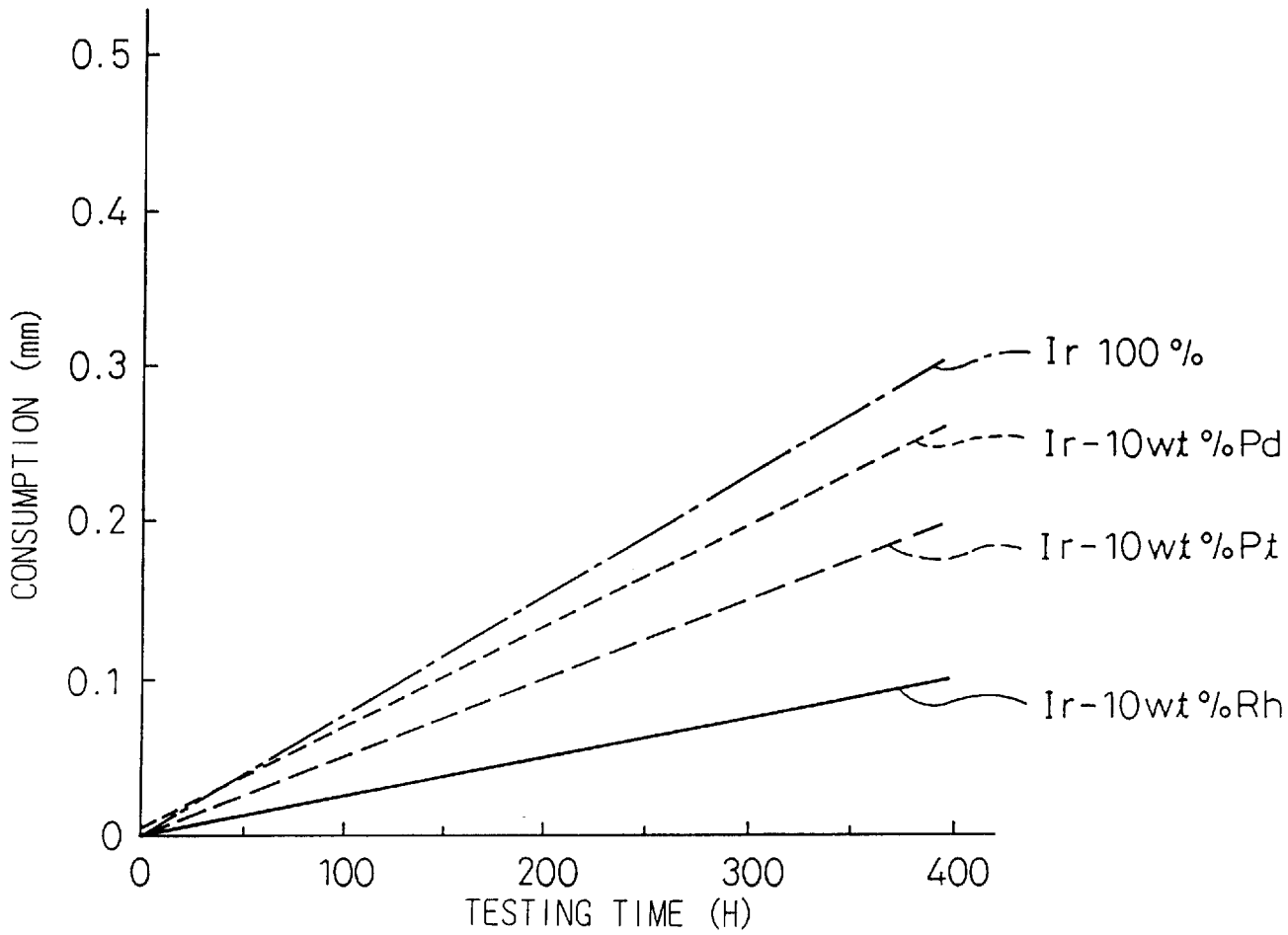
FIG. 3 is a graph showing the consumptions of various chips as a function of the testing time.

FIG. 3 shows the chip consumption in terms of the increment of the spark gap 7 during an engine endurance test for an Ir chip and Ir-based alloy chips containing any noble metal of the platinum families, i.e., Pt, Pd, or Rh.

The test was carried in a four-cycle, four-cylinder, 2000 cc engine continuously operated at a full load of 4000 rpm, during which the spark gap increment was measured. The tested plugs had a center electrode 3 and a ground electrode 4 with the noble metal chips made of the same metal or alloy.

The center electrodes 3 had noble metal chips 5 made of different materials of 100 wt % Ir, an Ir-10 wt % Pd alloy, an Ir-10 wt % Pt alloy, and an Ir-10 wt % Rh alloy. The chips 5 had a unified dimension of an outer diameter A of 1.0 mm and a height B of 1.5 mm.

The ground electrodes 4 had noble metal chips 6 made of the same materials as those of the counterpart center electrodes 3 and had a unified dimension of an outer diameter C of 1.0 mm and a height D of 0.5 mm.

As can be seen from FIG. 3, the test result shows that the addition of another noble element in Ir reduces the chip consumption and improves the consumption resistance and the lifetime. The improvement is most evident when Rh is added in Ir.

The material of 100 wt % Ir only provided a small improvement, because Ir forms a volatile $IrO_3$ oxide at temperatures near 1000° C. causing a large consumption even though Ir has a high melting point.

Then, the addition of any of less volatilizable noble metals of Pd, Pt, and Rh prevents the volatilization consumption of Ir. The addition of Rh is most effective, mostly because Rh has a melting point of 1960° C., which is higher than those of Pt (1769° C.) and Pd (1552° C.).

Although, in the tested plugs, the noble metal chip 5 of the center electrode 3 had a dimension of an outer diameter A of 1.0 mm and a height B of 1.5 mm, the noble metal chip 5 of the center electrode 3 preferably has an outer diameter of from 0.5 mm to 2.0 mm. When the chip 5 has an outer diameter A of less than 0.5 mm, the consumption resistance is greatly reduced and a long lifetime cannot be achieved. On the other hand, when the noble metal chip 5 has an outer diameter A of more than 2.0 mm, the ignitability is reduced and the discharging voltage is increased, and accordingly, the improvement in the plug performance is reduced.

The chip height B of the noble metal chip 5 is preferably within the range of from 0.3 mm to 2.5 mm. The chip height B of the noble metal chip 5 must be 0.3 mm or more to ensure stable welding thereof with the center electrode 3. On the other hand, when the chip height B is more than 2.5 mm, the noble metal chip 5 will be easily broken.

Although, in the tested plugs, the noble metal chip 6 of the ground electrode 4 had a dimension of an outer diameter C of 1.0 mm and a height D of 0.5 mm, the noble metal chip 6 of the ground electrode 4 preferably has an outer diameter C of from 0.5 mm to 1.7 mm. When the chip 6 has an outer diameter C of less than 0.5 mm, the consumption resistance is greatly reduced and a long lifetime cannot be achieved. On the other hand, when the noble metal chip 6 has an outer diameter C of more than 1.7 mm, the chip 6 cannot provide stable welding because the size is excessively large relative to that of the ground electrode 4.

The chip height D of the noble metal chip 6 is preferably within the range of from 0.3 mm to 1.0 mm. The chip height D of the noble metal chip 6 must be 0.3 mm or more to ensure stable welding thereof with the ground electrode 4. On the other hand, when the chip height D is more than 1.0 mm, the consumption of the chip 6 is greatly increased by a significant elevation of the chip temperature.

Based on the result that the addition of Rh in Ir increases the consumption resistance, a detailed study was conducted to estimate the consumption resistance of the Ir—Rh alloy. Fourteen Ir—Rh chips having different contents of Rh were tested to determine the consumption resistance under the same conditions as used in the above-described test including the chip dimensions. The results are summarized in Table 1, in which the chip consumption is shown in terms of the gap increment after a 400-hour engine endurance test.

It can be seen from Table 1 that, when the Ir—Rh alloy contains Rh in an amount of 1.0 wt % or more, the chip consumption is 0.18 mm or less, indicating a remarkable improvement in the consumption resistance. Because the noble metal chip 5 or 6 becomes easier to break at the edge as the Rh content is increased, the Rh content of the noble metal chip 5 or 6 of a spark plug must not be more than 60 wt %.

The consumption resistance is further improved, if an oxide of a group 3A element (such as $Y_2O_3$) or an oxide of a group 4A element (such as $ZrO_2$) of the periodic table is added in the Ir—Rh alloy, as can be also seen from Table 1, particularly the data for Chips 11 to 14.

The Ir—Rh alloy of the present invention may further contain one or more elements of the platinum families other than Rh, i.e., Pt and Pd, and/or one or more heat resistant metals such as Ni, in an amount causing no substantial reduction in the advantageous effect provided by the combination of Ir and Rh, as can be seen from Table 1, particularly Chips 8 to 10.

Rh may be added in Ir by either process of melting or sintering. The present inventors confirmed that both processes provide substantially the same improvement in the consumption resistance.

Although spark plugs having noble metal chips 5 and 6 in both the center electrode 3 and the ground electrode 4 were discussed above, the present invention can be also advantageously applied to spark plugs in which only the center electrode 3 has a noble metal chip 5 and the ground electrode 4 does not have a noble metal chip 6.

TABLE 1

| Chip No. | Composition (wt%) | Consumption (mm) | Estimation |
|---|---|---|---|
| 1 | 100 Ir | 0.30 | x |
| 2 | Ir-0.3Rh | 0.27 | x |
| 3 | Ir-1.0Rh | 0.18 | o |
| 4 | Ir-3.0Rh | 0.13 | ⊙ |
| 5 | Ir-10Rh | 0.10 | ⊙ |
| 6 | Ir-30Rh | 1.12 | ⊙ |
| 7 | Ir-60Rh | 0.15 | o |
| 8 | Ir-10RH-l0Pt | 0.15 | o |
| 9 | Ir-10Rh-0.5Ni | 0.11 | ⊙ |
| 10 | Ir-10Rh-5.0Ni | 0.19 | o |
| 11 | Ir-10Rh-0.5$Y_2O_3$ | 0.09 | ⊙ |
| 12 | Ir-10Rh-5.0$Y_2O_3$ | 0.08 | ⊙ |
| 13 | Ir-10RH-0.5$ZrO_2$ | 0.09 | ⊙ |
| 14 | Ir-10Rh-5.O$ZrO_2$ | 0.08 | ⊙ |
| 15 | Ir-3 Rh-10 Pd | 0.18 | o |
| 16 | Ir-3 Rh-l0 Ru | 0.13 | ⊙ |
| 17 | Ir-3 Rh-l0 Au | 0.20 | o |
| 18 | Ir-3 Rh-l0 Ni | 0.20 | o |
| 19 | Ir-3 Rh-l0 Pt | 0.16 | o |
| 20 | Ir-30Rh-l0 Ni | 0.20 | o |
| 21 | Ir-30Rh-l0 Ru | 0.12 | ⊙ |
| 22 | Ir-3 Rh-l5 Ni | 0.23 | Δ |
| 23 | Ir-3 Rh-15 Au | 0.24 | Δ |
| 24 | Ir-30Rh-5.0 Ni-0.5 $Y_2O_3$ | 0.16 | o |
| 25 | Ir-30Rh-5.0 Ni-5.0 $Z_rO_2$ | .16 | o |

⊙Excellent
o Good
ΔSmall Improvement
x No Improvement

We claim:

1. A spark plug for an internal combustion engine, comprising:

an insulation porcelain having a throughhole;

a center electrode held at one end of the throughhole;

a housing holding the insulation porcelain;

a ground electrode disposed at a front end of the housing and facing the center electrode;

a spark gap defined by the center electrode and the ground electrode; and at least one of the center electrode and the ground electrode having a noble metal member bonded to a discharging spot of a front end thereof, wherein the noble metal member consists of 90 wt % or more of an Ir—Rh alloy containing 1 to 60 wt % Rh and the balance substantially consisting of at least one of Pt, Pd, Ru, Au and Ni.

2. A spark plug as in claim 1, wherein the noble metal member consists of 90 wt % or more of an Ir—Rh alloy containing 3 to 30 wt % Rh.

3. A spark plug for an internal combustion engine, comprising:

an insulation porcelain having a throughhole;

a center electrode held at one end of the throughhole;

a housing holding the insulation porcelain;

a ground electrode disposed at a front end of the housing and facing the center electrode;

a spark gap defined by the center electrode and the ground electrode; and at least one of the center electrode and the ground electrode having a noble metal member bonded to a discharging spot of a front end thereof, wherein the noble metal member consists of 90 wt % or more of an Ir—Rh alloy containing 1 to 60 wt % Rh and the balance substantially consisting of 0.5 to 5 wt % of an oxide of an element of the group 3A or 4A of the periodic table and at least one of Pt, Pd, Ru, Au and Ni.

4. A spark plug as in claim 3, wherein the noble metal member consists of 90 wt % or more of an Ir—Rh alloy containing 3 to 30 wt % Rh.

* * * * *